United States Patent [19]

Nicholson

[11] 4,173,913

[45] Nov. 13, 1979

[54] HOLE CUTTER HAVING ROTATABLE BLADE CARRIER

[76] Inventor: Barrie F. Nicholson, 23 Showell Ln., Lower Penn, Wolverhampton, England

[21] Appl. No.: 884,386

[22] Filed: Mar. 8, 1978

[30] Foreign Application Priority Data

Mar. 8, 1977 [GB] United Kingdom ..... 9749/77

[51] Int. Cl.[2] ..... B26D 3/00

[52] U.S. Cl. ..... 83/555; 30/310; 83/353; 83/564; 83/594; 83/596

[58] Field of Search ..... 30/310; 83/555, 564, 83/591-596, 648, 578, 553, 522; 408/87, 88, 99, 100, 101

[56] References Cited

U.S. PATENT DOCUMENTS

| | | | |
|---|---|---|---|
| 181,138 | 8/1876 | Brix | 83/490 |
| 210,778 | 12/1878 | Harris | 83/594 X |
| 1,527,763 | 2/1925 | Vance | 83/490 |
| 2,943,392 | 7/1960 | Attridge | 30/310 |
| 3,027,640 | 4/1962 | Zimmerman | 30/310 |
| 3,429,042 | 2/1969 | Lawrence | 30/310 X |
| 3,994,194 | 11/1976 | Moczri | 30/310 X |
| 4,060,893 | 12/1977 | Matsuura | 30/310 |

*Primary Examiner*—J. M. Meister

*Attorney, Agent, or Firm*—Scrivener, Parker, Scrivener & Clarke

[57] ABSTRACT

The cutter is primarily intended for use in cutting holes of various sizes in self-adhesive pads used by people who have had Ilyostomy and collostomy operations. It consists of a holder in the form of a hinged case for a square pad, a rotatable blade carrier, and a blade adjustably carried in a radial slot in the blade carrier. The blade carrier is formed in two parts having a snap engagement with each other, and the arrangement is such that on release of the two parts from each other all of the components may be separated for cleaning.

10 Claims, 10 Drawing Figures

HOLE CUTTER HAVING ROTATABLE BLADE CARRIER

SPECIFIC DESCRIPTION

This invention relates to a device for cutting a hole in a piece of sheet material, and is primarily concerned with a device for cutting a hole in a self-adhesive patch used by people who have had a Ilyostomy or Collostomy operation to attach a bag to the abdomen.

The invention may however by used for cutting holes in any suitable sheet material such as paper, soft plastics, metal foil etc.

The self adhesive patches which are conventionally used by such people comprise a sheet of gelatin carried on a sheet of backing paper. Since different operations result in different sized holes it has been necessary for people to cut holes in the patches to suit their individual requirements, usually by means of a marker disc and curved scissors or using a circular steel knife set in a plastics base.

Devices have been proposed of the compass type for the industrial cutting of sheet material and in which one leg of the compass comprises a blade. Such devices can be made adjustable, but it is necessary to place the sheet material on a durable flat surface during cutting, and this may be unhygeinic. Also, such devices would be difficult to manipulate, particularly by people with failing sight or blind people.

The object of the invention is to provide a device which is capable of holding a piece of sheet material during cutting and which is capable of cutting holes of different sizes.

According to the invention a device for cutting a hole in a piece of sheet material comprises a holder for the material and a blade carried by a blade carrier which is rotatably mounted on or in the holder, the arrangement being such that in use a hole is cut by the blade in the material placed in the holder on rotation of the blade carrier, and the blade being adjustable in position relative to the rotational axis of the carrier to enable holes of different sizes to be cut.

Usually the device will be arranged to cut a circular hole in the material, but if desired it may be arranged, by the use of a suitably shaped cam guiding the blade for example, to cut oval holes or holes of other shapes.

Preferably the blade is slidably guided for adjustment purposes in a substantially radially extending slot in the carrier.

Means may be provided for locking the blade in position in the carrier, but preferably the arrangement is such that the friction between the blade and the carrier is sufficient to prevent movement during cutting.

The carrier is preferably provided with a scale to indicate the size of the hole that will be cut in dependence upon the position of the blade relative to the scale. The scale may only be a visual scale, but preferably it is provided in relief to enable it to be read by a blind person.

The holder preferably comprises two opposed walls between which is defined a cavity to receive the piece of sheet material, the blade carrier being rotatably carried by one of the walls.

Although the walls could be releasably connectible together they are conveniently hinged together, and when the walls are made of plastics they are preferably formed with the hinge as an integral plastics moulding.

Said other wall of the holder may be provided on its inner face with a series of recesses corresponding to the paths executed by the cutting edge of the cutting blade in cutting a series of holes of different sizes. When the cutter is adapted to cut only round holes then these recesses will each be annular and arranged in a concentric series. The recesses permit flexing of the adhesive pad adjacent to the blade to allow the backing paper to remain uncut.

Preferably the holder is provided with a hole, and the blade carrier comprises first and second parts which are adapted to be secured together and to overlap opposite sides of the hole so as to retain the carrier to the holder.

In order to enable rapid disassembly of the device for cleaning, the two parts are preferably provided with complementary formations having a snap engagement with each other.

A device for cutting round holes in square self-adhesive patches and in accordance with the invention will now be described, by way of example only, with reference to the accompanying drawings in which.

Figure 2:
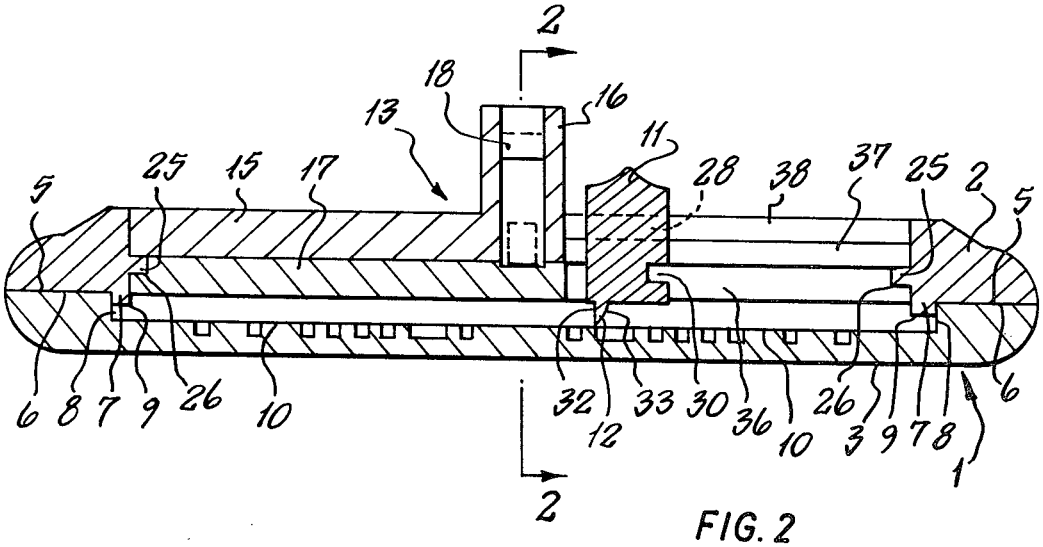
FIG. 2 is a further transverse cross-sectional view of the device taken on the line 3—3 of FIG. 1.
Figure 3:
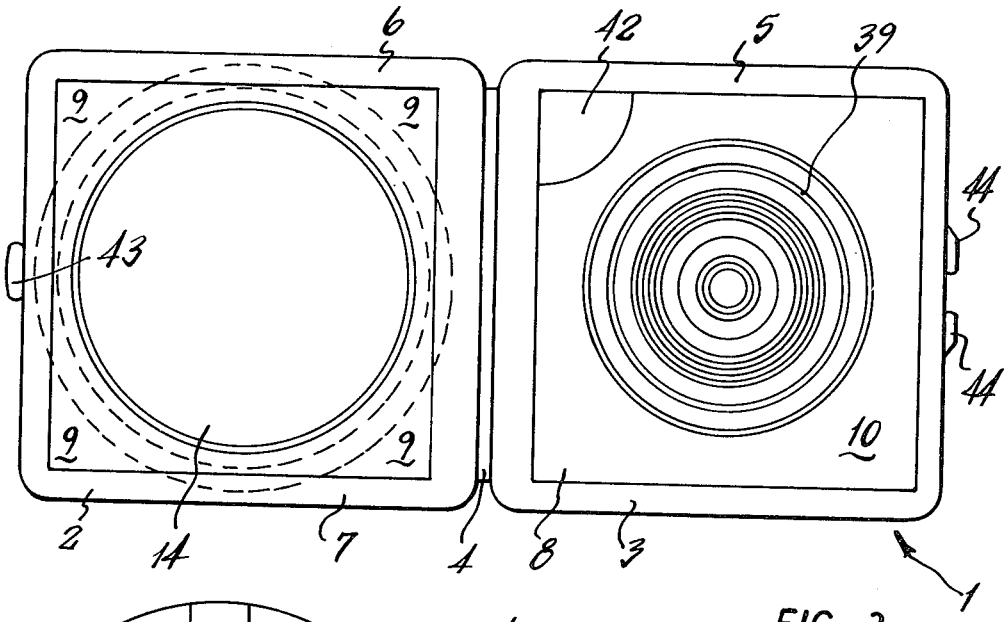
FIG. 3 is a plan view on a smaller scale of the holder in its fully open position.
Figure 4:
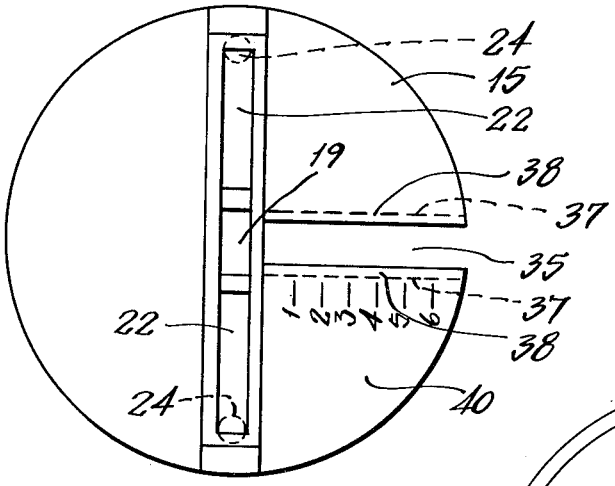
FIG. 4 is a plan view of the first part of the blade carrier.
Figure 5:
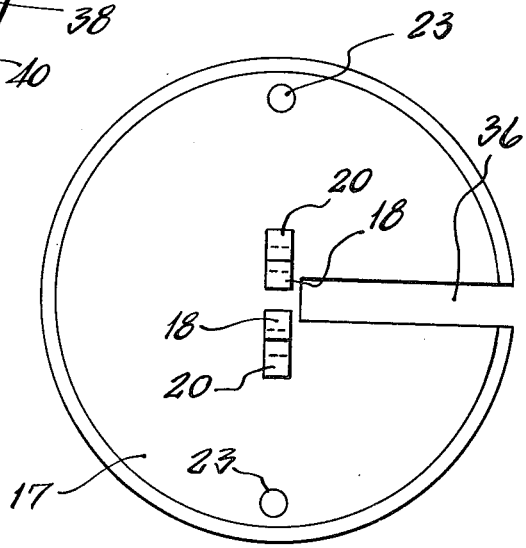
FIG. 5 is a plan view of the second part of the blade carrier.

As is shown in FIG. 3, the holder 1 comprises two substantially square plate-like portions 2 and 3 connected together by a hinge 4 in the form of an integral web, the holder being moulded from plastics material and in the open position shown in FIG. 3. The hinge 4 enables the two portions to be hinged to the closed position shown in FIGS. 1 and 2 in which peripheral bands 5 and 6 are in face contact with each other, and a raised part 7 of holder portion 2 and of square outline is received within a recess 8 in holder portion 3 and of complementary square outline. The height of the raised part 7 is less than the depth of recess 8 such that the parallel opposed walls 9 and 10 of the raised part 7 and recess 8 respectively are spaced apart to enable an adhesive pad to be located between them, the pad being chosen to have a square outline corresponding to the outline of recess 10 such that it fits snugly therein. A typical pad is 4 inches square.

Figure 1:
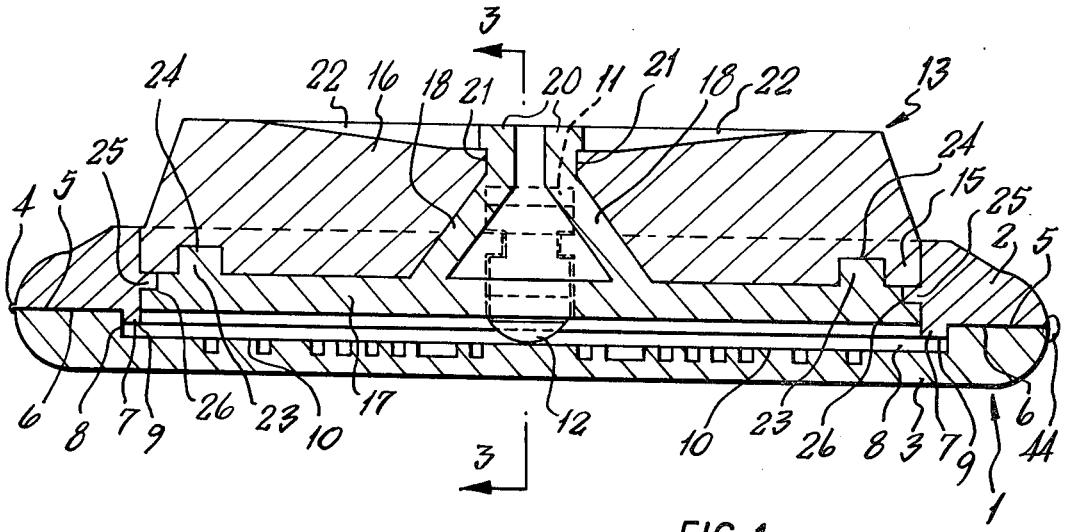
FIG. 1 is a transverse cross-sectional view of the assembled device taken on the line 2—2 of FIG. 2 and with the holder closed.

As is shown in FIG. 1 and 2, a blade 11 provided with a cutting part 12 is carried in a blade carrier 13 rotatably mounted in a circular hole 14 in holder portion 2 and comprising a moulded plastics disc-shaped first part 15 provided with an upstanding diametrically extending handle 16, and a moulded plastics disc-shaped second part 17, held in face contact with the first part 15 by a pair of integral upstanding resilient arms 18 received within a recess 19 of complementary outline defined in the handle 16 of first part 15. Arms 18, and the corresponding sides of recess 19, are upwardly and inwardly directed, but have outwardly turned free ends 20 which engage over opposed corners 21 to hold the two parts 15 and 17 together. Radially extending recesses 22 in the upper face of the handle enable the user with two fingers to grip the ends 20 of arms 18 and squeeze them together to disengage the ends 20 from corners 21 and allow the two parts 15 and 17 to be separated for cleaning and sterilisation.

It will be appreciated that the two parts 15 and 17 are readily fastened together merely by locating the arms 18 in recess 19 and pressing the parts 15 and 17 together, the oppositely inclined walls of recess 19 engaging with the ends 20 of the arms to push them together and allowing them to pass through the constricted upper portion of recess 19 and then snap into position around corners 21. Diametrically spaced pegs 23 upstanding from second part 17 are received in complementary holes 24 in the lower surface of part 15 to assist in locating the parts 15 and 17 circumferentially relative to each other.

The blade carrier 13 is held captive to the holder portion 2 by an inwardly directed flange 25 of holder portion 2 surrounding hole 14, opposite sides of which are overlapped by the peripheries of the two blade carrier parts 15 and 17, the periphery of second part 17 being provided with an annular recess 26 to receive flange 25. Sufficient clearance is, of course, allowed between parts 15 and 17 and flange 25 to enable the blade carrier 13 to be rotated with ease.

Figure 6:
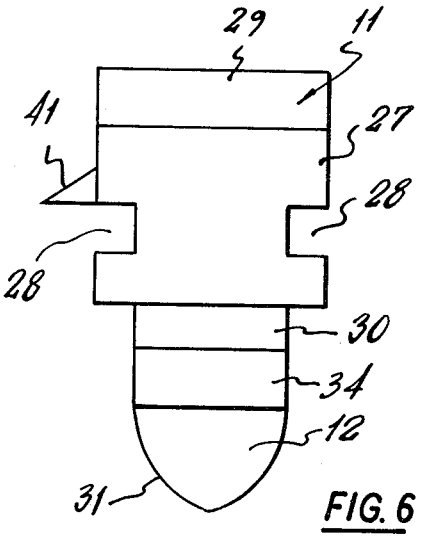
FIG. 6 is an enlarged view of the blade looking in the direction of the arrow X in FIG. 8.

With reference to FIGS. 6 to 10 the blade comprises a substantially rectangular block 27 provided in opposed sides with identical parallel slots 28, on its upper surface with a projection 29 which may be gripped between finger and thumb to adjust the position of the blade, and at one end with a transverse slot 30. The integral cutting part 12 extending downwardly from block 27 has a cutting edge 31 which is symmetrically shaped when viewed in the longitudinal direction of slots 28, as shown in FIG. 6, and is defined by the intersection of a planar face 32 with a convex face 33.

Figure 7:
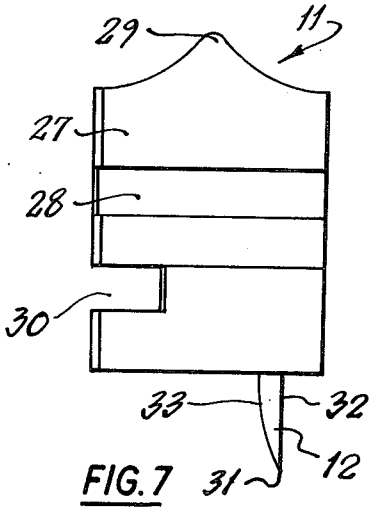
FIG. 7 is a view of the blade looking in the direction of the arrow Y in FIG. 8.
Figure 9:
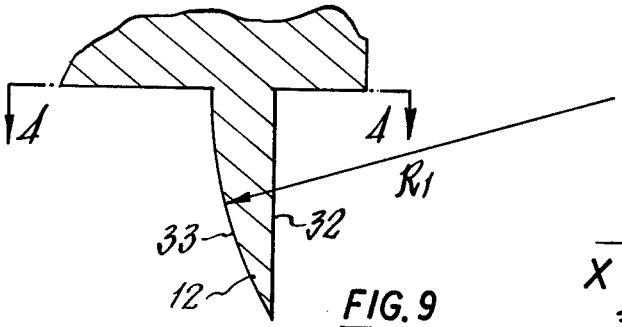
FIGS. 9 and 10 are enlarged views of the cutting part of the blade.
Figure 8:
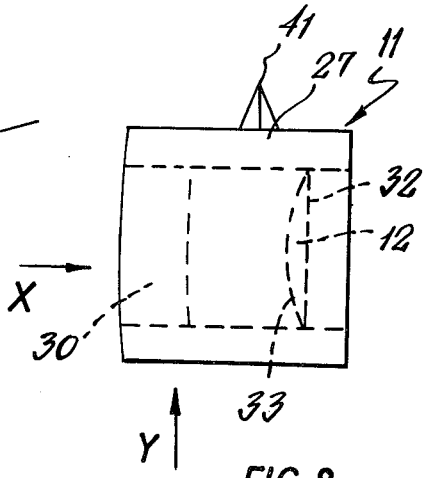
FIG. 8 is a plan view of the blades.
Figure 10:
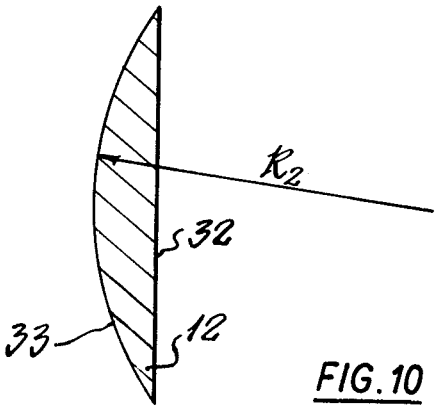

The precise shape of the convex face 33 is shown in FIGS. 9 and 10 in which FIG. 9 is a view corresponding to FIG. 7 but on a larger scale, and FIG. 10 is a section on the line 4—4 of FIG. 9. The convex face 33 has two radii of curvature $R_1$ and $R_2$ of which $R_1$ is greater than $R_2$. Typical values for $R_1$ and $R_2$ are 0.308 and 0.215 inches respectively. The shapes of the faces 32 and 33 are chosen such that the blade is effective for cutting the full range of hole diameters.

As shown in FIG. 6, the lower part 34 of the block 27 is of reduced width compared with that of the upper part.

The mounting of the blade in the blade carrier will now be described with reference to FIGS. 1 to 5. The first and second parts 15 and 17 of the blade carrier 13 are formed with identical radial slots 35 and 36 respectively which are open at their outer ends and which are in register with each other in plan view when the parts 15 and 17 are connected together. The underside of the first part is, however, cut away at 37 on either side of slot 35 so as to define two opposed ribs 38 upon which the blade is slidably guided, ribs 38 being received within the respective slots 28, and the reduced thickness part 34 of the blade extending downwards through slot 36 in the second part 17 when the two parts 15 and 17 are connected together. With the holder in the closed position the lower extremity of the cutting edge of the cutting part 12 is arranged such that it projects by 0.025 inches into one of a series of annular recesses 39 formed in wall 10 of lower holder portion 3. This figure is appropriate to a typical pad of thickness. It will be seen from FIG. 2 that the planar surface 32 of the cutting part 12 faces radially inwardly of the blade carrier, and that slot 30 in the blade is adapted to fit over flange 25 to enable the blade to have a maximum possible radial travel.

The upper surface of the first part 15 of the blade carrier adjacent to the slot 35 is provided with a raised scale 40 which indicates the diameter of the hole that will be cut in a pad when a pointer 41 projecting from one side of the blade is aligned with a scale mark. The scale 40 and pointer 41 can be read by a blind person by touch, and if desired the scale may be in braille.

It will be appreciated that once the first part 15 of the blade carrier has been removed from the holder the blade 11 may be slid from the end of slot 35 for cleaning purposes, but that the blade is normally held captive in the blade carrier 13. Thus, disengagement of the two carrier parts 15 and 17 enables all of the parts to be separated for cleaning.

The purpose of the annular grooves 39 is to allow a conventional adhesive pad comprising a square sheet of gelatin backed by a square sheet of backing paper to flex sufficiently into a groove as the blade edge passes over it such that only the gelatin layer is cut when the pad is placed in the holder with the gelatin layer uppermost in FIGS. 1 and 2.

Since the blade edge 31 is symmetrical in shape in the circumferential direction of the blade carrier, the blade is equally effective for both directions of rotation of the blade carrier 13.

The dimensions of the slots 28 are preferably chosen such that the blade 11 is frictionally held against radial movement during cutting, but if desired the upper surface of the first carrier part 15 adjacent to slot 35 and the co-operating surface of the blade may be roughened to increase the friction forces.

The blade 11 is formed of polycarbonate, but if desired it may be formed of any other suitable material such as metal or glass fibre reinforced plastics.

The holder, as shown in FIG. 3, is provided in portion 3 with a fingerhole 42 to enable a finger to be pushed through that portion 3 to lift the pad from that portion of the holder after cutting. Portions 2 and 3 of the holder are provided with projections 43 and 44 respectively which have a snap engagement with each other to retain the holder closed during cutting. Such projections are of the kind commonly used on powder compacts.

It will now be appreciated that a round hole may be cut in a pad merely by inserting the pad into recess 8 in the holder portion 3, sliding the cutter 11 radially to align pointer 41 with the desired mark of scale 40 to determine the hole size, closing the holder, and then turning the knob 16 through 360°. The holder is then opened by pressing projections 43 and 44 transversely relative to each other, and the pad removed by pushing a finger through hole 42.

What I claim:

1. A device for cutting a hole in a piece of sheet material comprising a holder for the material, a blade carrier rotatably carried by said holder, a blade carried by said blade carrier, whereby a hole is cut in the material placed in said holder on rotation of said blade carrier, and adjustment means enabling adjustment of the position of said blade relative to the rotational axis of said blade carrier whereby holes of different sizes may be cut, said holder being provided with a hole, and said blade carrier comprising first and second parts overlapping opposite sides of said hole, and releasable securing means connecting said first and second parts, wherein said releasable securing means comprises complementary formations on said parts having a snap engagement with each other to secure said parts together.

2. A device as in claim 1, wherein said two parts are of substantially disc shape.

3. A device as in claim 1, including a handle on said first part, said complementary formations comprising a recess in said handle and at least one projection on said second part received within said recess and having a snap engagement therewith.

4. A device for cutting a hole in a piece of sheet material comprising a holder for the material, a blade carrier rotatably carried by said holder, a blade carried by said carrier, whereby a hole is cut in the material placed in said holder on rotation of said blade carrier, and adjustment means enabling adjustment of the position of said blade relative to the rotational axis of said blade carrier whereby holes of different sizes may be cut, said blade including a cutting edge of substantially symmetrical shape whereby material is cut for either direction of rotation of said blade carrier, said cutting edge being defined by the junction between a substantially planar face and a convex surface, said planar face facing radially inwardly of said blade carrier.

5. A device as in claim 4, wherein said holder defines a cavity for receiving a square piece of sheet material.

6. A device for cutting a hole in a piece of sheet material comprising a holder for the material, a blade carrier rotatably carried by said holder, a blade carried by said blade carrier, whereby a hole is cut in the material placed in said holder on rotation of said blade carrier, and adjustment means enabling adjustment of the position of said blade relative to the rotational axis of said blade carrier whereby holes of different sizes may be cut, said holder being provided with two spaced apart substantially parallel walls between which the piece of sheet material is positioned, the rotational axis of the carrier extending normally to the walls, said holder comprising two portions provided with said walls, and a hinge connecting together said portions, said wall facing said blade being provided with a finger hole to enable the piece of material to be pushed from said holder following cutting.

7. A device as in claim 6 wherein said two holder portions and said hinge are formed as an integral plastics moulding.

8. A device as in claim 6 including further releasable fastening means retaining said holder closed during cutting.

9. A device as in claim 6 wherein said wall facing said blade is provided with a series of recesses corresponding to the paths executed by the cutting edge of said blade in cutting a series of holes of different sizes.

10. A device as in claim 9 wherein said cutting edge projects into one of said recesses.

* * * * *